US011292106B2

(12) United States Patent
Greco

(10) Patent No.: US 11,292,106 B2
(45) Date of Patent: Apr. 5, 2022

(54) LOCKING PLIERS WITH MODULAR TOOL INSERT

(71) Applicant: Michael Greco, San Diego, CA (US)

(72) Inventor: Michael Greco, San Diego, CA (US)

( * ) Notice: Subject to any disclaimer, the term of this patent is extended or adjusted under 35 U.S.C. 154(b) by 197 days.

(21) Appl. No.: 16/574,040

(22) Filed: Sep. 17, 2019

(65) Prior Publication Data

US 2021/0078139 A1 Mar. 18, 2021

(51) Int. Cl.

| | |
|---|---|
| ***B25B 7/22*** | (2006.01) |
| ***B25B 7/02*** | (2006.01) |
| ***B25B 7/12*** | (2006.01) |
| *B26B 5/00* | (2006.01) |
| *B26B 11/00* | (2006.01) |

(52) U.S. Cl.

CPC ..... *B25B 7/22* (2013.01); *B25B 7/02* (2013.01); *B25B 7/123* (2013.01); *B26B 5/00* (2013.01); *B26B 11/00* (2013.01)

(58) Field of Classification Search

CPC .. B25B 7/22; B25B 7/02; B25B 7/123; B25B 7/12; B25B 7/14; B25B 7/16; B25B 7/10; B25B 7/04; A45D 29/02; B08B 1/005; B26B 1/00; B26B 3/00; B26B 1/08; B26B 3/06; B26B 5/00; B26B 5/001; B26B 5/002; B26B 5/003; B26B 5/006; B26B 29/025; B26B 29/02; B26B 11/00; B27B 19/02; A47L 13/02; B27G 17/00; B27G 17/04; A61B 17/3213; A61B 17/3217

See application file for complete search history.

(56) References Cited

U.S. PATENT DOCUMENTS

| | | | | |
|---|---|---|---|---|
| 1,567,943 | A * | 12/1925 | Grush | B27G 17/04 30/335 |
| 4,020,555 | A * | 5/1977 | Hedrick | B23D 51/10 30/392 |
| 7,313,989 | B1 * | 1/2008 | Tortolani, Jr. | B25B 5/127 81/355 |
| 8,171,646 | B2 * | 5/2012 | Chiu | A47L 13/022 30/169 |
| 8,356,415 | B2 * | 1/2013 | Lin | B26B 5/00 30/169 |
| 8,707,833 | B1 * | 4/2014 | Gedeon | B25B 7/10 81/414 |
| 10,350,646 | B1 * | 7/2019 | Nichols, Jr. | B08B 1/005 |
| 2017/0246731 | A1 * | 8/2017 | Wu | B25B 7/123 |

* cited by examiner

*Primary Examiner* — Robert J Scruggs

(57) ABSTRACT

This invention is a set of locking pliers which includes a modular locking system to allow for tool inserts to be secured between the jaws of the pliers.

12 Claims, 5 Drawing Sheets

LOCKING PLIERS WITH MODULAR TOOL INSERT

BACKGROUND

This invention relates generally to locking pliers and, more particularly, to an improved release mechanism for such pliers and a corresponding tool insert which can be locked into a vacancy inside the plier jaws.

Pliers-type hand tools with toggle-locking mechanisms are generally known as locking pliers. These pliers usually comprise a fixed handle having a fixed jaw on one end thereof. A movable jaw and a movable handle are pivotal relative to the fixed handle to open and close the jaws. To operate the pliers the movable handle is closed relative to the fixed handle to close the jaws and seize a workpiece firmly therebetween. The handles are then tightly compressed such that the toggle mechanism locks the pliers onto the workpiece. The pliers will remain firmly locked in place without the continuous application of force by the user.

The pliers may comprise a relatively simple toggle-locking mechanism where a single link has one end pivotably connected to the movable jaw and the opposite end adjustably and pivotably received in the movable handle such as shown in U.S. Pat. No. 4,546,680. The pliers may also comprise a more complex toggle-locking mechanism that uses a compound linkage where multiple links are pivotably connected to one another between the fixed handle and the movable handle such as shown in U.S. Pat. No. 5,056,385. The locking pliers may also comprise self-adjusting pliers such as shown in U.S. Pat. No. 6,941,844. Other embodiments of locking pliers are also known.

Because an over-center locking mechanism is used, once the pliers are locked in position, they cannot be opened by a force applied to the jaws. The pliers can only be released by a force applied to the links of the locking mechanism. This may be accomplished by pulling the ends of the handles apart from one another. If the locking force is great, a significant force must be applied to separate the handles and open the pliers. To make opening the pliers easier a release mechanism has been developed. The release mechanism typically comprises a lever pivotably connected to the movable handle at a pivot pin such that the first end of the lever is disposed between and is contacted by a link of the locking mechanism and the fixed handle when the jaws are in the closed and locked position. By pushing on the opposite end of the lever, the lever pivots about the pivot pin forcing the first end of the lever away from the handle to release the locking mechanism.

Because the plier jaws only secure the items held in the jaws by clamping force, it is difficult for the tool to be used as a handle for tool blade inserts such as knives or saws. An addition of a negative void of a tool insert that corresponds with the positive protrusion of the locking jaws creates a more sufficient grasp on the tool insert.

Thus, an improved gripping mechanism for locking pliers and a vacancy in the jaws for which to secure tool blades is desired.

The tool insert can be made of multiple types of materials such as, Carbon steel, stainless steel, metal, metal composites, plastic polymers, ceramics or any other material which is used for tool purposes. The multiple tool designs can be knives, saws, chisels, files, rasps, edged blades, axes, hatchets, machetes, hex shaped tools, bottle openers, skinning blades, fileting blades, chopping blades, wood working blades, or any tool in which can be held by a handle. All bladed tools with the corresponding modular locking shape can be used.

The handle can have multiple changes to it as well, such as, no toothed jaw which locks into the tool insert, rubberized handles, an ergonomic design used for fitting the human hand, an extended release lever which has differing purposes such as a baseplate, hammer tool.

SUMMARY OF THE INVENTION

The locking pliers comprises a first handle connected to a first jaw. A second handle and second jaw are pivotably connected to the first handle and first jaw such that movement of the first handle relative to the second handle causes the jaws to open and close. A mechanism is provided to lock the jaws relative to one another and apply a clamping or gripping force on a tool insert positioned between the jaws. A release mechanism is provided to unlock the pliers that is independent of the locking operation.

DETAILED DESCRIPTION OF EMBODIMENTS OF THE INVENTION

Figure 1:
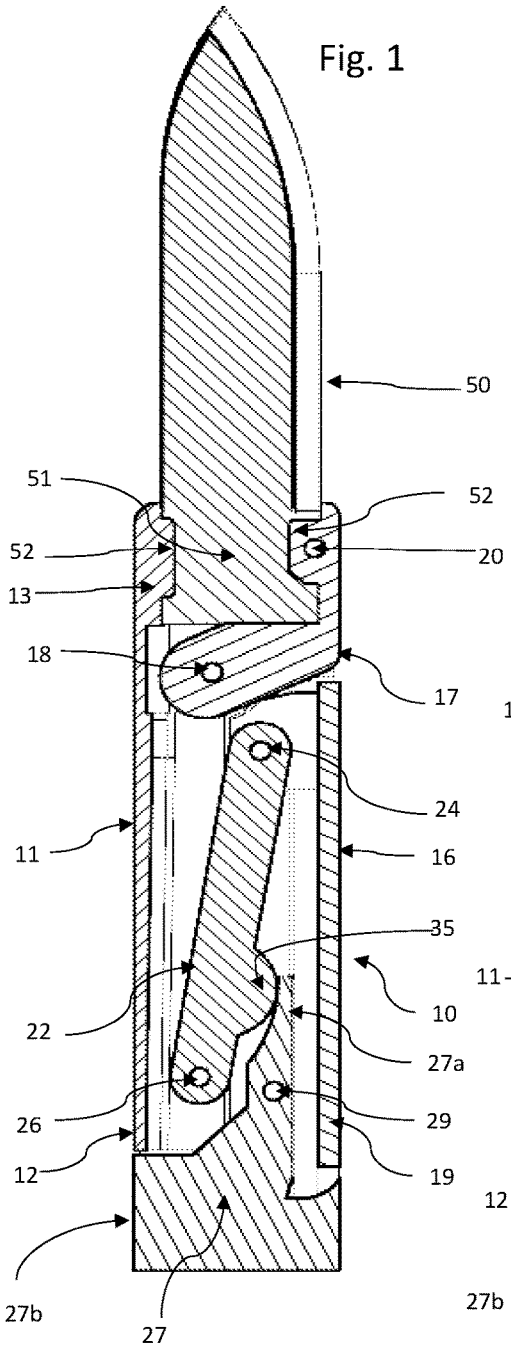
FIG. 1 is a cut-away side view of the locking plier tool in the locked position with the tool insert locked in place.

The release mechanism of the invention is intended to be used with any locking pliers that use a linkage to lock the jaws in position and apply the clamping force by the jaws to a work piece including simple toggle-locking mechanisms, compound toggle-locking mechanisms and self-adjusting locking pliers. Various configurations of the toggle locking mechanisms, jaws and handles may be used in conjunction with the release mechanism of the invention. The jaws may be shaped to function as long nose pliers, pliers with curved jaws, serrated jaws, C-clamps, C-clamps with swivel pads, hole punches, or any other kind of hand tool where the toggle-locking action is useful.

For purposes of explaining the construction and operation of the adjustment mechanism of the invention, one such locking pliers 10 will be described in detail with reference to the figures. Pliers 10 include a fixed arm 11 having a fixed handle 12 at one end and a fixed jaw 13 at the other end. A movable arm 16 includes a movable handle 19 and a movable jaw 17. Movable jaw 17 is pivotably connected to the movable handle 19 by pivot pin 20. A pivot pin 18 connects the movable jaw 17 to the fixed arm 11. A link 22 is pivotably connected to the movable arm 16 by pivot pin 24. The opposite end of link 22 is pivotably supported in fixed arm 11 at pivot 26. Link 22 is free to pivot relative to pivot 26 and arm 11 such that the abutting engagement of link 22 with pivot 26 creates a pivot.

While a simple toggle-locking mechanism comprising a double-link 22 is shown, it is to be understood that the toggle-locking mechanism may comprise other configurations including compound toggle-linking mechanisms and/or self-adjusting mechanisms.

When the jaws 13 and 17 are in the open position, the pivot points, 18, 20, 24 and 26 are arranged as a polygon. When the jaws are in the closed, locked position as shown in FIG. 2, the pivots 20, 24 and 26 are substantially in a straight line where pin 24 is slightly over-center, toward fixed arm 11, of a line between pivots 20 and 26.

Figure 2:
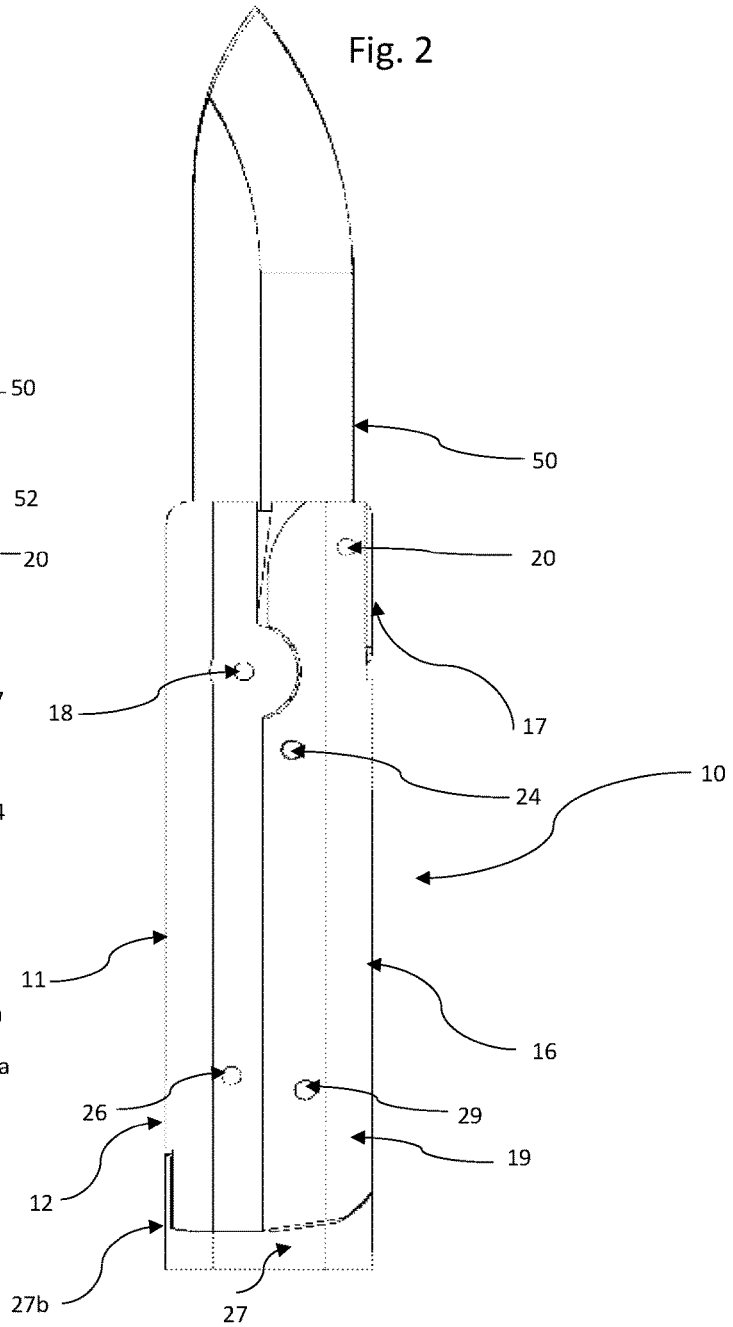
FIG. 2 is a side view of the locking plier tool with the tool insert locked in place.
Figure 3:
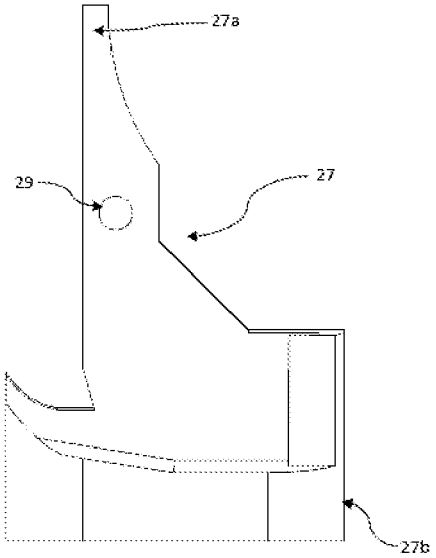
FIG. 3 is a side view of the release lever.
Figure 4:
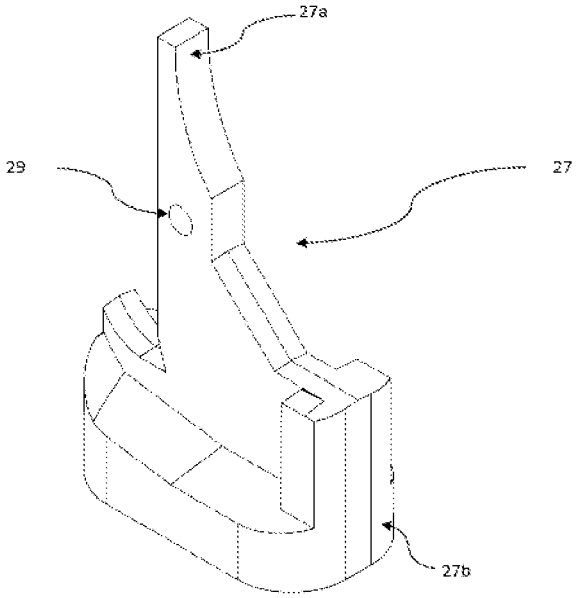
FIG. 4 is a perspective view of the release lever.
Figure 5:
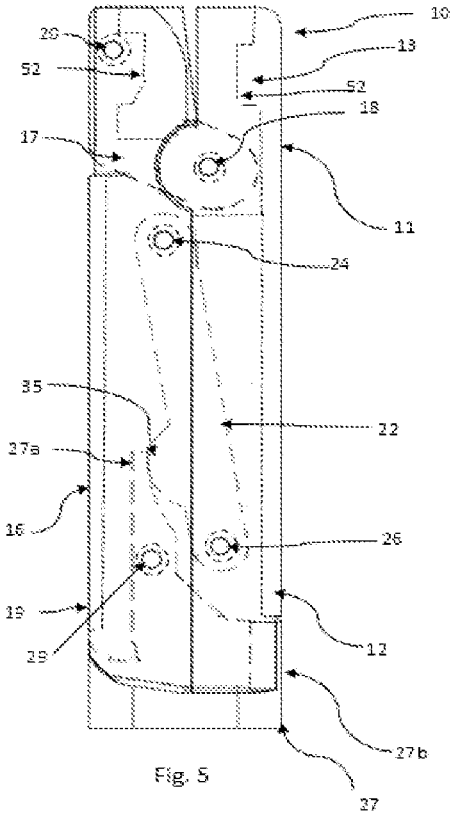
FIG. 5 is a cut away side view of the locking plier tool in the locked position without the tool insert.
Figure 6:
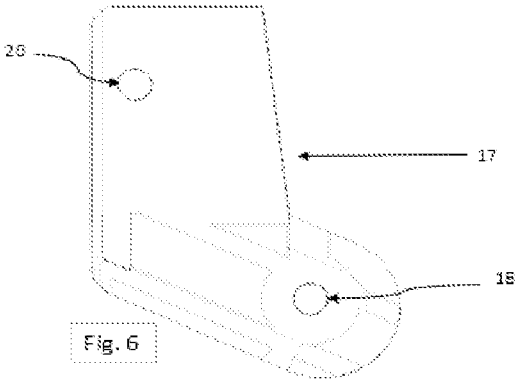
FIG. 6 is a side view of the moveable jaw.
Figure 7:
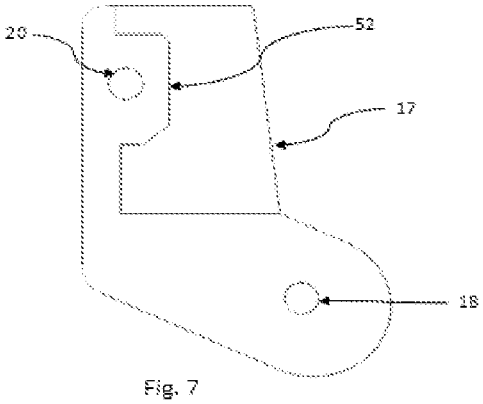
FIG. 7 is a cut away side view of the moveable jaw.
Figure 8:
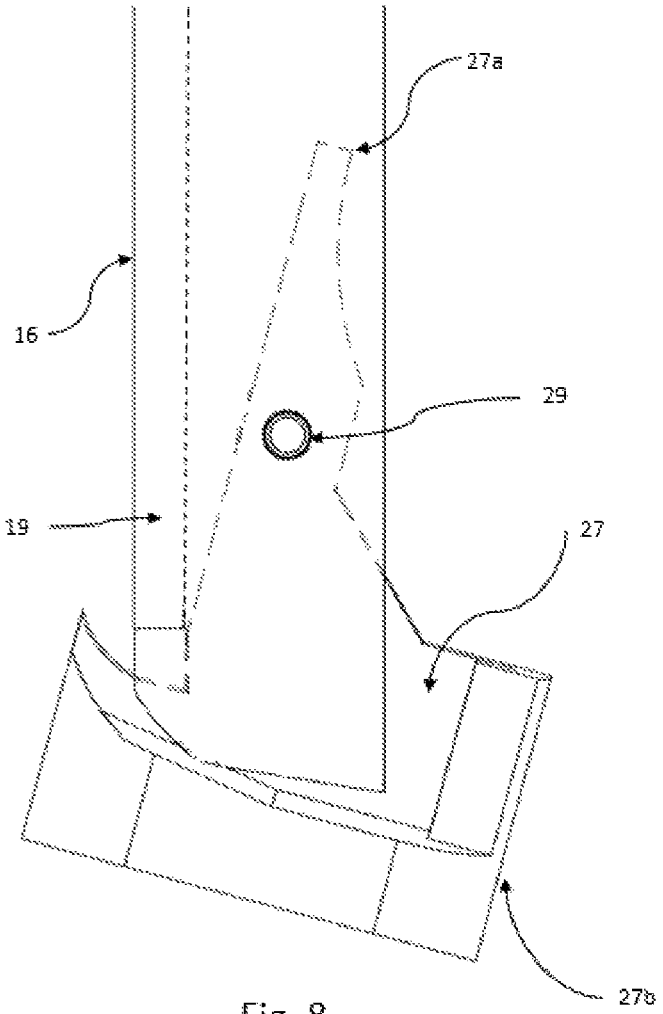
FIG. 8 is a cut away side view of the release lever in the unlocked position.
Figure 9:
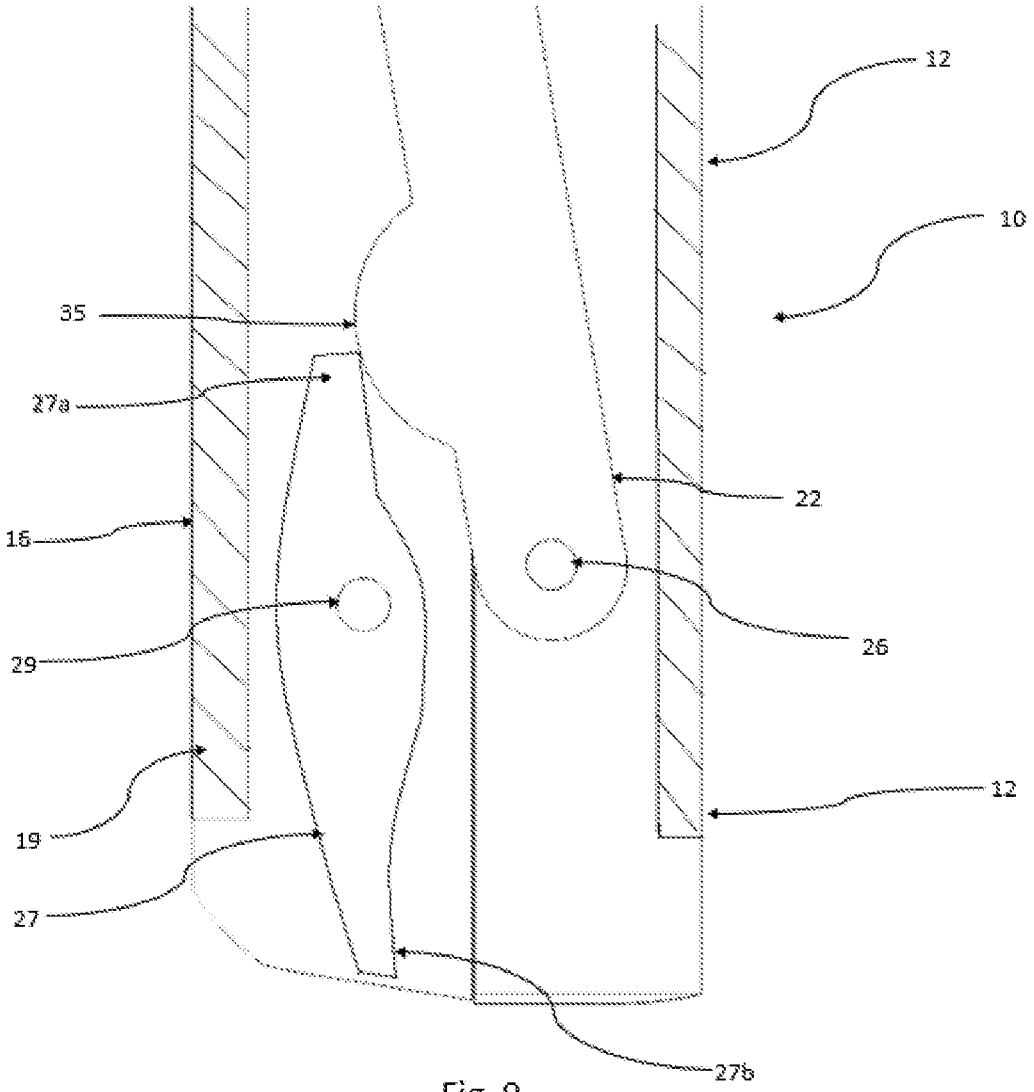
FIG. 9 is a cut away sideview of another embodiment of the release lever.

When the jaws 13 and 17 are in the closed, locked position as shown in FIG. 1 and FIG. 2, the tool insert base 51 of the tool insert 50 is clamped between jaws 13 and 17 in an inwardly extended portion that forms an L shaped recess with extended portions that extend outwardly from the inwardly extended portion 52. Any configuration of tool insert 50 and the tool insert base 51 which can held when the mechanism is in a locked position when the jaws are closed or grasping, can be considered a tool insert.

The "throw" of the linkage is the distance the linkage moves from the unlocked position to the locked over-center clamping position. When the tool insert is clamped between the jaws and increasing force is applied to the handles 12 and 19, the forces generated on the linkage cause link 22 to pivot and the linkage begins to straighten and the effective length of the linkage between pivots 20 and 26 increases. As the effective length of the linkage increases, increasing force must be applied to the handles 12 and 19 to move the linkage to the over-center locked position. This force is transmitted through the pliers to the work piece to increase the clamping force generated by the jaws on the work piece.

It should be further understood that the "over-center" condition of the pivots 20, 24 and 26, which maintains the jaws in a locked position, also includes an arrangement where pins 20, 24 and 26 are aligned "dead center," that is, in a straight line. Any configuration of pivot pins and stops which places the mechanism in a locked position when the jaws are closed or grasping a tool insert, can be considered an over-center mechanism when force applied directly to the jaws to separate the jaws is not effective in moving the jaws and the jaws can only be opened by forces acting on the links of the mechanism.

Once locked, the jaws 13 and 17 cannot be pried apart from the locked position by a force acting on the jaws 13, 17 because separation of the jaws is prevented by the over-center condition of the pivots 20, 24 and 26. However, the jaws 13, 17 may be separated by applying a force to the movable handle 19 in a direction which moves the movable handle 19 away from the fixed handle 12. Depending on the amount of force generated through the pliers in the locked position, the force applied to the handles to open the pliers may be relatively large.

A release mechanism is provided to facilitate opening of the jaws. Specifically, lever 27 is pivotably connected to arm 16 at pivot pin 29. The end 27*a* of lever 27 is disposed between link 22 and movable arm 16 when the jaws are in the closed and locked position.

The end 27*a* of lever 27 cooperates with the link protrusion 35 to release the jaws.

By pushing on the opposite end 27*b* of lever 27, lever 27 pivots about pivot pin 29 forcing end 27*a* away from handle 19 to contact link 22 at protrusion 35. The force exerted by lever 27 on protrusion 35 is sufficient to move link 22 and release the locking mechanism.

The pliers discussed with reference to the Figures use a push type release lever where one end of the lever is pushed toward the handle 19 to force the opposite end of the lever into engagement with the link 22. The locking mechanism of the invention may also be used with pull type release levers where the lever is pulled away from handle 19 and into engagement with link 22.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A lockable pliers comprising:

a fixed handle including a fixed arm, a fixed jaw and an inwardly extended portion extending from the fixed jaw toward a longitudinal axis, wherein the inwardly extended portion includes an upper surface, a lower surface and a side surface all of which engage with a first side of a base of a tool insert;

a movable handle that is movable relative to the fixed handle between an open position and a closed, locked position, wherein the movable handle includes a movable arm, a movable jaw and an inwardly extended portion extending from the movable jaw toward the longitudinal axis, wherein the inwardly extended portion includes an upper surface, a lower surface and a side surface all of which engage with a second side of the base of the tool insert;

a locking mechanism having a link for locking the movable jaw in the closed, locked position; and a release lever pivotally connected to said movable handle.

2. The fixed jaw and moveable jaw of claim 1 that when in the locked position completely envelops the side surfaces of the base of the tool insert which engages with the surfaces of the inwardly extended portions.

3. The fixed jaw and moveable jaw of claim 1 that when in the locked position partially envelops the side surfaces of the base of the tool insert which engages with the surfaces of the inwardly extended portions.

4. The release lever of claim 1 that has an extension that fits over the base area of the fixed and moveable handles when in the locked position.

5. The release lever of claim 1 that has an extension that partially fits over the base area of the fixed and moveable handles when in the locked position.

6. The release lever of claim 1 that has an extension that when in the closed position partially or fully fits the base of the fixed and moveable handles when in the locked position but also has an extension that intersects a void in the fixed handle.

7. A lockable pliers comprising:

a fixed handle including a fixed arm, a fixed jaw and an inwardly extended portion extending from the fixed jaw toward a longitudinal axis, wherein the inwardly extended portion includes an upper surface, a lower surface and a side surface all of which engage with a first side of a base of a tool insert;

a movable handle that is movable relative to the fixed handle between an open position and a closed, locked position, wherein the movable handle includes a movable arm, a movable jaw and an inwardly extended portion extending from the movable jaw toward the longitudinal axis, wherein the inwardly extended portion includes an upper surface, a lower surface and a side surface all of which engage with a second side of the base of the tool insert, wherein the moveable jaw within the movable handle pivotally rotates around a pivot point that is parallel to and adjacent to the upper surface area of the inwardly extended portion;

a locking mechanism having a link for locking the movable jaw in the closed, locked position; and a release lever pivotally connected to said movable handle.

8. The fixed jaw and moveable jaw of claim 7 that when in the locked position completely envelops the side surfaces of the base of the tool insert which engages with the surfaces of the inwardly extended portions.

9. The fixed jaw and moveable jaw of claim 7 that when in the locked position partially envelops the side surfaces of the base of the tool insert which engages with the surfaces of the inwardly extended portions.

10. The release lever of claim 7 that has an extension that fits over the base area of the fixed and moveable handles when in the locked position.

11. The release lever of claim 7 that has an extension that partially fits over the base area of the fixed and moveable handles when in the locked position.

12. The release lever of claim 7 that has an extension that when in the closed position partially or fully fits the base of the fixed and moveable handles when in the locked position but also has an extension that intersects a void in the fixed handle.

* * * * *